US007870770B2

(12) United States Patent
Blanch

(10) Patent No.: US 7,870,770 B2
(45) Date of Patent: Jan. 18, 2011

(54) THREE MODE LOCK

(75) Inventor: David Garfield Blanch, Nottinghill (AU)

(73) Assignee: Assa Abloy Australia Pty Limited (AU)

( * ) Notice: Subject to any disclaimer, the term of this patent is extended or adjusted under 35 U.S.C. 154(b) by 730 days.

(21) Appl. No.: 10/597,417

(22) PCT Filed: Jan. 30, 2004

(86) PCT No.: PCT/AU2004/000107

§ 371 (c)(1),
(2), (4) Date: Oct. 25, 2006

(87) PCT Pub. No.: WO2005/073489

PCT Pub. Date: Aug. 11, 2005

(65) Prior Publication Data

US 2008/0236213 A1 Oct. 2, 2008

(51) Int. Cl.
*E05B 47/06* (2006.01)
*E05B 55/04* (2006.01)

(52) U.S. Cl. ..... 70/279.1; 70/210; 70/278.7; 70/283; 70/467; 70/468; 70/483; 70/485; 292/169.15

(58) Field of Classification Search ..... 70/467–471, 70/475–485, 489, 150, 153, 278.3, 278.7, 70/279.1, 283, 210; 292/347, 359, DIG. 52, 292/169.14–169.17, 169.21–169.23
See application file for complete search history.

(56) References Cited

U.S. PATENT DOCUMENTS 891,562 A * 6/1908 McPherson ..... 70/467
2,315,815 A * 4/1943 Rightmyer ..... 292/169.15
2,648,969 A * 8/1953 Miller et al. ..... 70/485
2,651,934 A * 9/1953 Chesler ..... 70/485
2,769,330 A * 11/1956 O'Connell ..... 70/97
2,784,993 A * 3/1957 Collar ..... 292/223
3,242,707 A * 3/1966 Kenaga ..... 70/101
4,363,231 A * 12/1982 Kaveney, Jr. ..... 70/484
4,427,223 A * 1/1984 Godec et al. ..... 292/92
4,545,607 A * 10/1985 Yulkowski ..... 292/216
4,594,864 A 6/1986 Hart
4,900,073 A * 2/1990 Doolan ..... 292/169.22
4,979,383 A 12/1990 Tully
5,123,682 A 6/1992 Robida et al.
5,636,882 A * 6/1997 Hook ..... 292/359
5,651,568 A 7/1997 Fortune et al.
5,826,924 A * 10/1998 Huang ..... 292/359
5,909,919 A * 6/1999 Wang ..... 292/359
6,519,984 B1 * 2/2003 Morris ..... 70/210
2006/0144103 A1 * 7/2006 Blanch ..... 70/330
2007/0113602 A1 * 5/2007 Watts ..... 70/107

* cited by examiner

*Primary Examiner*—Lloyd A Gall
(74) *Attorney, Agent, or Firm*—Schmeiser, Olsen & Watts, LLP

(57) ABSTRACT

A door lock (10) having a lock body (11), an external handle and an internal handle (12), a rotatable interconnecting member (13) to interconnect the internal handle and the external handle, and a mechanism to allow the lock to have a passage mode, and a privacy mode and a deadlock mode, in one embodiment the mechanism comprises an outer hub (14) and an internal hub (15) which are inside the lock body, in a second embodiment a remote control arrangement is provided to allow at least some of the modes to be operated manually or by remote control.

27 Claims, 8 Drawing Sheets

THREE MODE LOCK

FIELD OF THE INVENTION

This invention is directed to a lock and in particular to a front door lock which contains a particular mechanism which allows the lock to be a "three mode lock" by which is meant that the lock can have a passage mode, a privacy mode, and a deadlock mode. The lock may be a mechanical lock or an electromechanical lock whereby the lock can be operated using a remote signal device.

BACKGROUND ART

Locks, and particularly door locks, can function in a number of different modes. One known mode is a passage mode. The passage mode is a mode where the door can be opened from the inside and the outside by turning the door handle, and there is no mechanism to lock either side of the door. These types of locks are widely used in houses.

Another known mode is a privacy mode. In the privacy mode, the door can be locked from the outside by turning a snib or similar type of member on the inside of the door. The door can be opened from the inside, either by turning a snib, or by simply turning the handle which overrides the looking mechanism to allow the door to be opened from the inside. However, the door is locked from the outside, This type of mode is widely used in bathroom doors and some front doors.

Another known mode is a deadlock mode. In the deadlock mode the door is locked from the inside and from the outside and usually requires a key to open the door. Deadlocking locks are very common and are widely used on front doors.

Locks are known which combine at least some of the above modes. For instance, locks are known which combine the privacy mode and the deadlocking mode. Other types of combination locks are also known.

Locks which combine all three of the above modes are not very well-known. Moreover, such locks can be quite complicated in design. Often, the design of these locks is not very secure and the locks can be manipulated or forced into a position where an intruder can gain access through the door.

More recently, there has been a desire to provide remote control locks, and particularly remote control door locks. The remote control door locks need to contain some form of mechanism to allow the lock to be operated by a remote signal. To date, there has been no multiple mode lock which has a remote control mechanism which can be built into the lock, or a multiple mode lock which may be manual in operation but which can be adapted for remote control with minimum reconfiguration of the lock.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide a multiple mode lock which may overcome at least part of the above-mentioned disadvantages or provide the consumer with a useful or commercial choice.

In one form, the invention resides in a lock which contains a mechanism to allow the lock to have a passage mode, and/or a privacy mode and/or a deadlock mode.

In another form, the invention resides in a remote control lock which contains a mechanism to allow the lock to have a passage mode and/or a privacy mode and/or a deadlock mode, and remote control means to allow at least some of the modes to be operated by remote control.

The lock will typically comprise a front door lock although the invention need not be limited to this particular use. The front door may comprise a swing door although the invention need not be limited to this particular type of door.

The lock will typically have an external handle (that is, a handle on the outside of the door) and an internal handle (that is, on the inside of the door). The handle may comprise a knob, a lever handle, or any other type of suitable handle. Indeed, the handle may comprise a snib like handle and the like.

The lock will typically have a look body which supports at least some of the mechanism. Typically, the lock body includes an interconnecting member to interconnect the internal handle with the external handle. The interconnecting member typically comprises a connecting bar which is typically square in cross-section, this type of connecting bar being well-known. It is well-known to provide a lock tongue which is operatively associated with the connecting bar such that rotation of the connecting bar about its longitudinal axis will cause retraction or extension of the lock tongue.

The lock may contain an outer hub and an internal hub. Each hub is typically positioned within the lock body and can form part of the lock mechanism. Suitably, the outer hub and the internal hub are positioned next to each other with the internal hub being positioned behind the outer hub and between the outer hub and the lock body. The outer hub and/or the internal hub may be substantially planar in configuration and may comprise members which are adapted for rotation in the lock body. Suitably, the outer hub is attached to, or relative to, the connecting bar such that rotation of the connecting bar causes rotation of the outer hub. Typically, this is achieved by providing a square passageway through the outer hub to allow the outer hub to be fixed to the connecting bar such that rotation of the connecting bar rotates the outer hub. Of course, other types of attachments are envisaged.

The internal hub is typically operatively associated with the internal handle such that rotation of the internal handle causes rotation of the internal hub. Various types of cooperative attachments of the internal handle to the internal hub are envisaged. The attachment of the internal hub is preferably such that the internal hub moves or rotates upon movement of the internal handle, but the internal hub does not necessarily move or rotate upon rotation of the external handle.

The internal hub and the outer hub are typically provided with engagement means to allow the internal hub and the outer hub to engage with a locking bar. The engagement means may comprise a simple recess or cutout portion in each hub although other types of engagement means are envisaged such as abutments, profiles and the like.

The lock mechanism may include a locking bar. The locking bar may be movable between a locking position where the locking bar engages with the outer hub and/or die internal hub, and a free position where the locking bar does not engage with the outer hub and/or the internal hub. The locking bar may be movable between the locking position and the free position in a sliding manner, a rotating manner, a combination of a sliding and rotating manner and the like. The locking bar may be substantially plate like in configuration and may contain a nose portion which is adapted for engagement with the internal hub and the outer hub. The term "locking bar" is to be considered broadly and may comprise other types of locking members or locking means which can function or operate in a manner identical or similar to that described above.

The lock may comprise a mechanism to allow it to move between a passage mode and a privacy mode. The mechanism may comprise the internal hub, the outer hub and the locking bar as described above. Suitably, when in the passage mode, the locking bar is in the free position enabling the lock to be opened from either side of the door. Suitably, when in the privacy mode, the locking bar is in the locking position which prevents operation of the external handle but still allows operation of the internal handle.

The locking bar may be movable between its locking position and its free position by an external member. The external member may comprise a snib mechanism. The snib mechanism may comprise an external snib on the outside of the lock and which can be manipulated to move the locking bar between the locking position and the free position.

The snib mechanism may be operatively connected to the locking bar. In one form, the snib mechanism may comprise a rotatable member containing an eccentric pin which is attached to the locking bar such that a "crank type" type mechanism is provided whereby rotation of the external snib causes reciprocal movement of the locking bar. Of course, other types of mechanisms are envisaged which may provide a similar or identical function. For instance, the external member may comprise a slide member which can slide the locking bar between the locking position and the free position.

When in the privacy mode, it is preferred that operation of the internal handle can cause the locking bar to move from the locking position to the free position (i.e. a kickback function). In one form, this can be achieved by providing an inclined surface or a ramped surface on the internal hub which may form part of the engagement means of the locking bar to the internal hub. The construction and arrangement may be such that rotation of the internal hub (by rotation of the internal handle) causes the inclined surface to engage with the nose portion of the locking bar to push the locking bar out of engagement with the internal hub (i.e. return the locking bar to the free position). Thus, when in the privacy mode the internal handle can be operated to move the locking bar back to the free position; however the external handle is prevented from doing so.

The lock may contain a lock barrel (cylinder). Suitably, the lock contains two lock barrels being an external lock barrel (external cylinder) and an internal lock barrel (internal cylinder). The internal cylinder may be key operated from the inside of the door and the external cylinder may be key operated from the outside of the door. Each cylinder is typically associated with a cam (this being conventional) and the cam is typically attached to the inner end of the cylinder. The cam usually contains a camming member which rotates upon insertion and rotation of a key into the cylinder.

Suitably, the lock is provided with an internal cylinder which is operatively associated with the locking bar. Thus, operation of the internal cylinder can operate the locking bar between the locking position and the free position. It is also preferred that the internal cylinder can deadlock the locking bar into the looking position by which is meant that the locking bar is unable to move to the free position unless the internal cylinder is unlocked by the key. Thus, it is possible for the lock to be deadlocked from the inside of the door.

In one form, a first drive member is provided to drive the locking bar between the locking position and/or the free position. The drive member may be rotatable. The drive member may be operated by the cam of the internal cylinder such that insertion and rotation of a key in the internal cylinder causes rotation of the internal cam which, in turn, operates the drive member to move the locking bar between the locking position and the free position. However, other types of mechanisms are envisaged to allow the internal cylinder to manipulate the locking bar.

Suitably, the above mechanism allows the lock to move from a passage mode to a privacy mode and a deadlock mode from the inside of the door. Movement from the passage mode to the privacy mode and vice versa may be available using the snib and movement from the passage mode to the privacy mode and the deadlock mode may be available using the internal cylinder.

The lock may contain a mechanism to allow at least some of the modes to be selected from the outside of the door. It is preferred that the lock contains a mechanism or means to allow the lock to operate between the deadlock mode, the privacy mode and the passage mode from the outside of the door.

In one form, this can be achieved by providing an external cylinder. The external cylinder may contain a cam such that insertion and rotation of the key in the external cylinder causes rotation of the cam. The cam (which can be called the external cam as it is attached to the external cylinder) may be operatively associated with the locking bar such that operation of the external cylinder can move the locking bar between the locking position and the free position and/or can also deadlock, the locking bar in the locking position. In one form, this can be achieved by providing a second drive member which can be operatively associated with the external cam such that rotation of the external cam causes rotation of the second drive member. The second drive member may be operatively associated with the first drive member such that rotation of the second drive member causes rotation of the first drive member, and, as the first drive member may be associated with the locking bar, this can cause the locking bar to move from its unlocking position to its locking position and vice versa. However, other mechanisms or means are envisaged which may allow the external cylinder to be operatively associated with the locking bar.

The lock may comprise a remote control lock such that at least some of the lock modes can be operated from a position remote to the lock. Suitably, the remote control allows the lock to move between the passage mode and the privacy mode.

Suitably, a signal generating means is provided to allow the lock to be operated between various lock modes. The signal generating means may comprise a small portable device which can be attached to a key ring etc. The signal itself may be of various types including a radio signal, an infrared signal, and the like (Proximity cards, fingerprint or keypads). The signal may be coded.

The lock may contain a receiver to sense the signal generating means. The receiver may comprise or include a microswitch. The lock may include a drive means. The drive means may comprise a motor or solenoid, which is typically a small electric motor. The drive means may be controlled by the microswitch. The drive means is typically operatively associated with the locking bar such that operation of the drive means can move the locking bar between the locking position and the unlocking position. It is envisaged that there will be various ways of operatively associating the drive means with the locking bar. In one form, their may be provided a drive member which moves the locking bar between the locking position and the free position. The drive member may be driven by the electric motor.

SUMMARY OF INVENTION

A first aspect of the invention provides a door lock having a lock body, an outer handle for operating the lock from an outer side of the door, an inner handle for operating the lock from an inner side of the door, and a mechanism inside the lock body to allow the lock to have a passage mode wherein the lock is operable by either handle, a privacy mode wherein the lock is operable by the inner handle but not the outer handle, and a deadlock mode wherein the lock cannot be operated by the handles, the mechanism comprising an outer hub operatively associated with the outer handle, an inner hub operatively associated with the inner handle and a locking member movably engageable and disengageable with respect to the outer hub and the inner hub, characterised in that when the lock is in the deadlock mode the locking member is maintained in engagement with the hubs to prevent operation of the lock by the handles, and further characterised in that when the lock is in the privacy mode, engagement of the locking member with the hubs prevents operation of the lock by the outer handle but upon operation of the inner handle the locking member disengages with respect to the hubs thereby returning the lock to the passage mode wherein the locking member is disengaged with respect to the hubs.

A second aspect of the invention provides a remote control lock which contains a mechanism to allow the lock to have a passage mode and/or a privacy mode and/or a deadlock mode, and remote control means to allow at least some of the modes to be operated by remote control.

A third aspect of the invention provides a lock containing three separate modes being a deadlock mode, a privacy mode and a passage mode.

BRIEF DESCRIPTION OF THE DRAWINGS

Embodiments of the invention will be described with reference to the following drawings in which.

DETAILED DESCRIPTION

Figure 1:
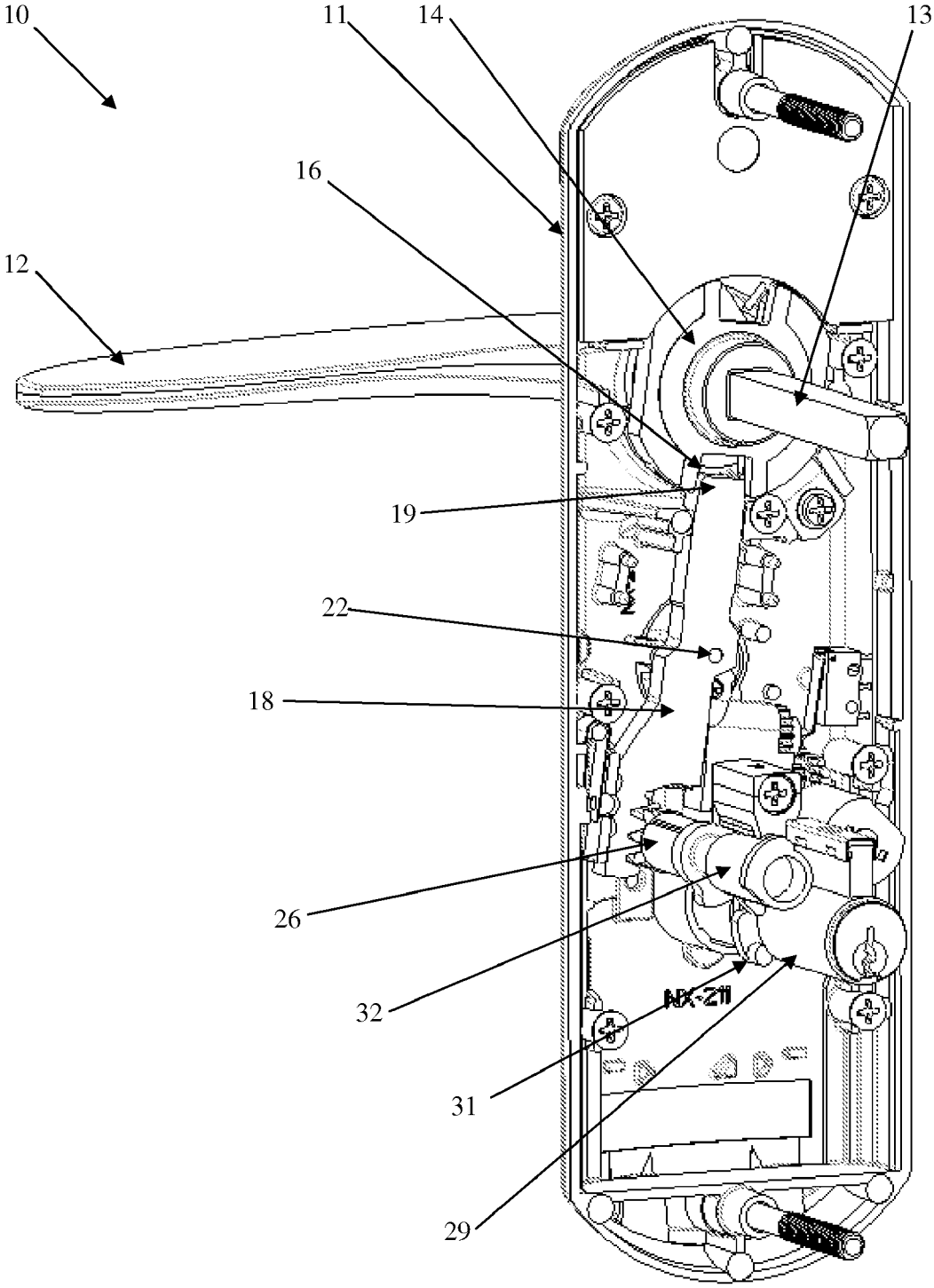
FIG. 1. Illustrates the internal components of the lock from one side and particularly illustrates the outer hub.
Figure 2:
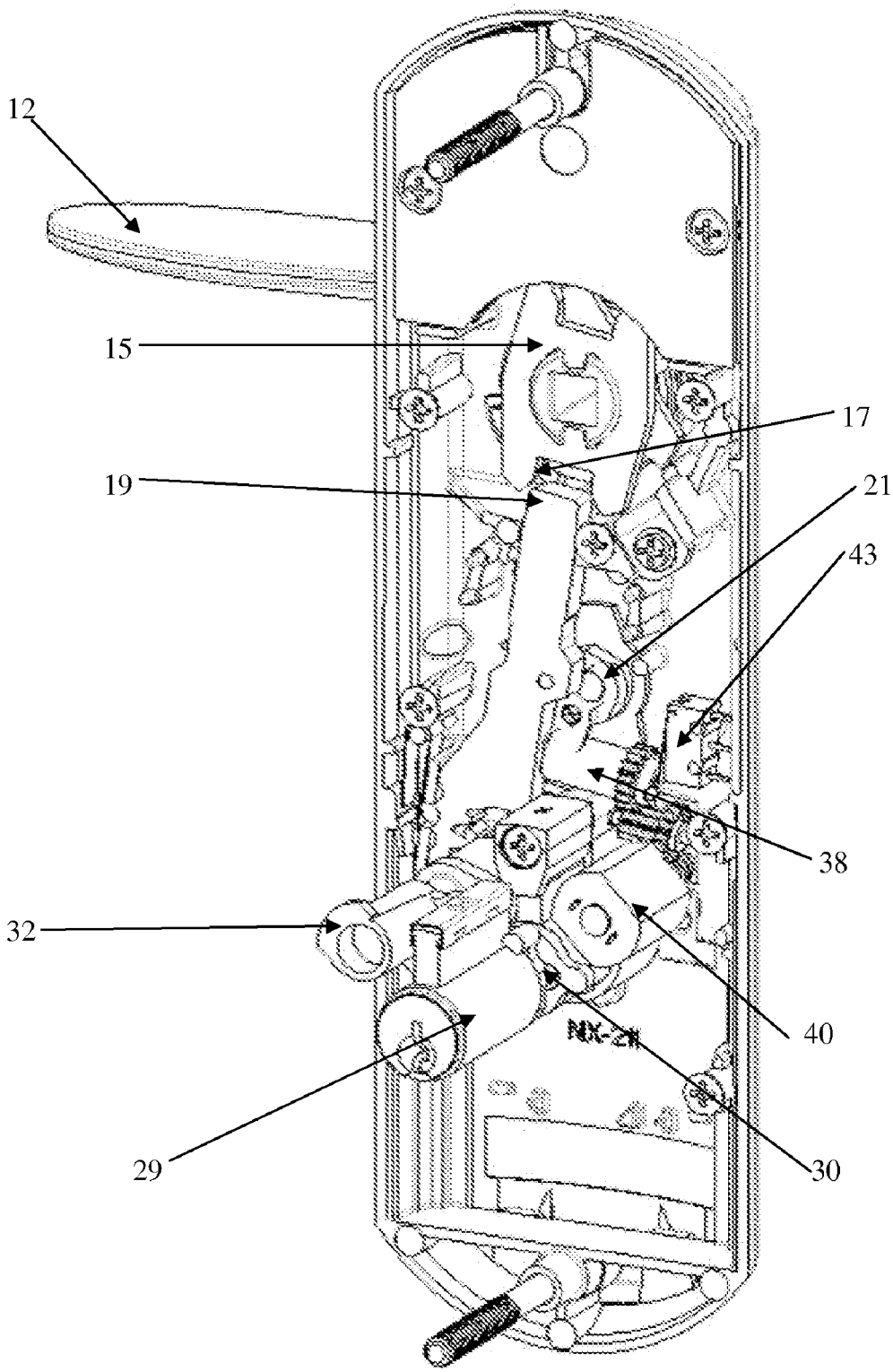
FIG. 2. Illustrates the internal components of the lock of FIG. 1 from the other side but with removal of the outer hub to more clearly illustrate the internal hub.

Referring to the drawings and initially to FIGS. 1 and 2, there is illustrated the components of the lock and according to an embodiment only of the invention. Lock 10 in the embodiment comprises a front door lock. Lock 10 has a lock body 11 to house the various internal components, an internal handle 12 (by which is meant that handle 12 is on the inside of the door), and various internal components which will be described in greater detail below. Not illustrated for reasons of clarity is an external handle, and a plate which would be similar to lock body 11 and which sits on the outside of the door.

The internal handle 12 and the external handle (not illustrated) are connected together in the normal manner by a connecting bar 13 which is typically substantially square in cross-section. A lock tongue assembly (not illustrated but of a conventional design) is operatively associated to connecting bar 13 such that rotation of connecting bar 13 (by operation of the internal handle 12 or the external handle) causes the lock tongue to move between a retracted position (to allow the door to open) and an extended position where the lock tongue enters into a keeper to prevent the door from opening. This arrangement is quite conventional.

The lock mechanism contains an outer hub 14 and an internal hub 15. FIG. 1 particularly illustrates outer hub 14 while FIG. 2 has the outer hub 14 removed to illustrate the inner hub 15. Thus, outer hub 14 and internal hub 15 are positioned next to each other with the internal hub 15 being positioned behind outer hub 14 and between outer hub 14 and lock body 11. Outer hub 14 is substantially plate like and is also substantially round and contains a cutout portion 16. Importantly, cutout portion 16 contains substantially parallel sidewalls such that the cutout portion is substantially U-shaped. This means that there is no inclined wall or ramped portion in cutout portion 16 of outer hub 14. The reason for this will be described below, Outer hub 14 is attached to bar 13 in such a manner that rotation of bar 13 causes rotation of hub 14. In the particular embodiment, this is achieved by having a square opening extending through outer hub 14 to allow it to slide over the top of bar 13 but prevents independent rotation of hub 14 relative to bar 13.

Referring to internal hub 15 (best illustrated in FIG. 2), this hub is also substantially plate like and somewhat rounded and also contains a cutout portion 17. However, the cutout portion 17 of internal hub 15 has inclined sidewalls 118 at the front of the cutout portion. Also, internal hub 15 is connected relative to handle 12 such that rotation of handle 12 causes rotation of internal hub 15. However, internal hub 15 is not directly attached to bar 13.

A locking bar 18 is provided in the lock. The locking bar 18 is substantially plate like and contains a nose portion 19 which is configured to enable it to pass at least partially within the cutout portion on the outer hub and the cutout portion on the internal hub. The locking bar 18 is slidingly movable between a forward locking position where the nose portion passes into the cutout portion and a retracted free position where the nose portion does not engage with the outer hub or the internal hub.

When the locking bar 18 is in the forward locking position (see FIG. 1), the nose portion is within the cutout portion of the outer hub 14. In this position, the external handle (not illustrated) cannot be rotated to retract the lock tongue (not illustrated) as bar 13 cannot be rotated because outer hub 14 is locked against rotation by locking bar 18. In this position, locking bar 18 is also in the cutout portion 17 of internal hub 15 this being best illustrated in FIG. 2. However, because cutout portion 17 has the inclined sidewalls 118, rotation of internal hub 15 will cause nose portion 19 to ride along the inclined sidewalls 118 to cause retraction of the locking bar back to the free position. Put differently, rotation of internal hub 15 can cause the locking bar 18 to be kicked away from engagement with the internal hub and the outer hub. The configuration of the cutout portion in the outer hub and the internal hub is such that is as the locking bar is kicked away from engagement with the internal hub, it will also retract out of the outer hub.

The internal hub 15 can be rotated by internal handle 12 as the internal hub is connected to or relative to handle 12. Thus, even when locking bar 18 is in the forward locking position, the internal handle can be rotated to "kick out" the locking bar from engagement with the internal hub and the outer hub which then allows the door to be opened. At this stage, the external handle can be operated to open the door and the lock is in the "passage mode".

Conversely, when the locking bar is in engagement with the outer hub and the internal hub, the lock is in the "privacy mode" which means that the door cannot be operated from the outside but can still be opened from the inside.

Figure 3:
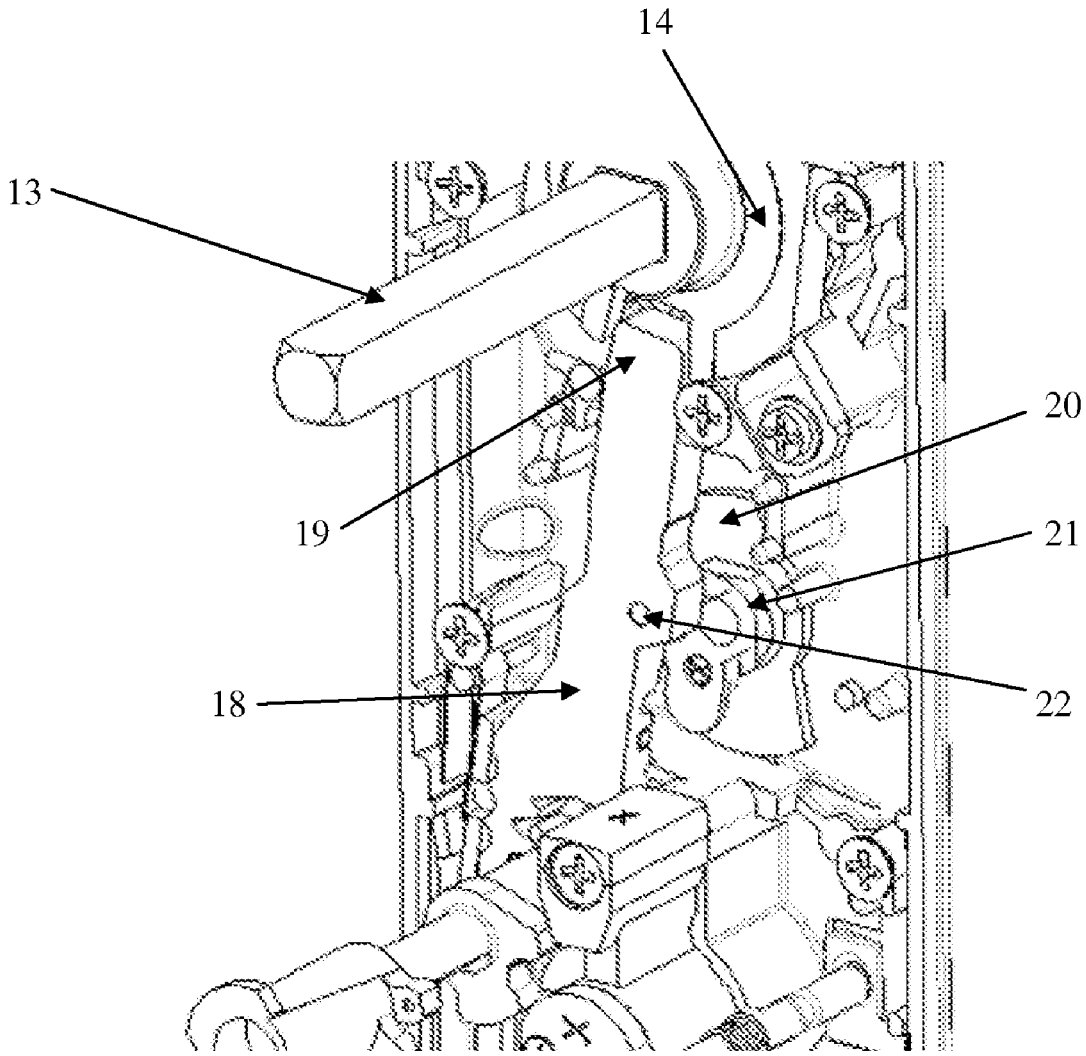
FIG. 3. Illustrates a close up view of the locking bar, the outer hub, and the internal snib mechanism to operate the locking bar.

Locking bar 18 can be moved from the free position to the locking position by an external mechanism which in the particular embodiment comprises a snib mechanism 20. The snib mechanism 20 contains an internal snib (by which is meant that the snib is on the inside of the door and typically below internal handle 12 and can be operated by a person). The internal snib is connected to a rotatable member 21 which is inside the lock and which contains an eccentric pin 22 to form a "crank" arrangement (see FIG. 3). Eccentric pin 22 is attached to locking bar 18 below nose portion 19. Thus, rotation of the snib will cause rotation of eccentric pin 22 which in turn will slide locking bar 18 from the retracted unlocking position to the extended locking position (the extended locking position being illustrated in FIG. 1 and FIG. 2).

In use, the door can be closed and a person on the inside of the door can manipulate the snib to make the lock adopt the "privacy mode". When in the privacy mode, the door can be returned to the passage mode either by rotation of the internal handle 12 which will kick out locking bar 18, or alternatively by manipulating the snib to retract the locking bar back into the free position.

Figure 4:
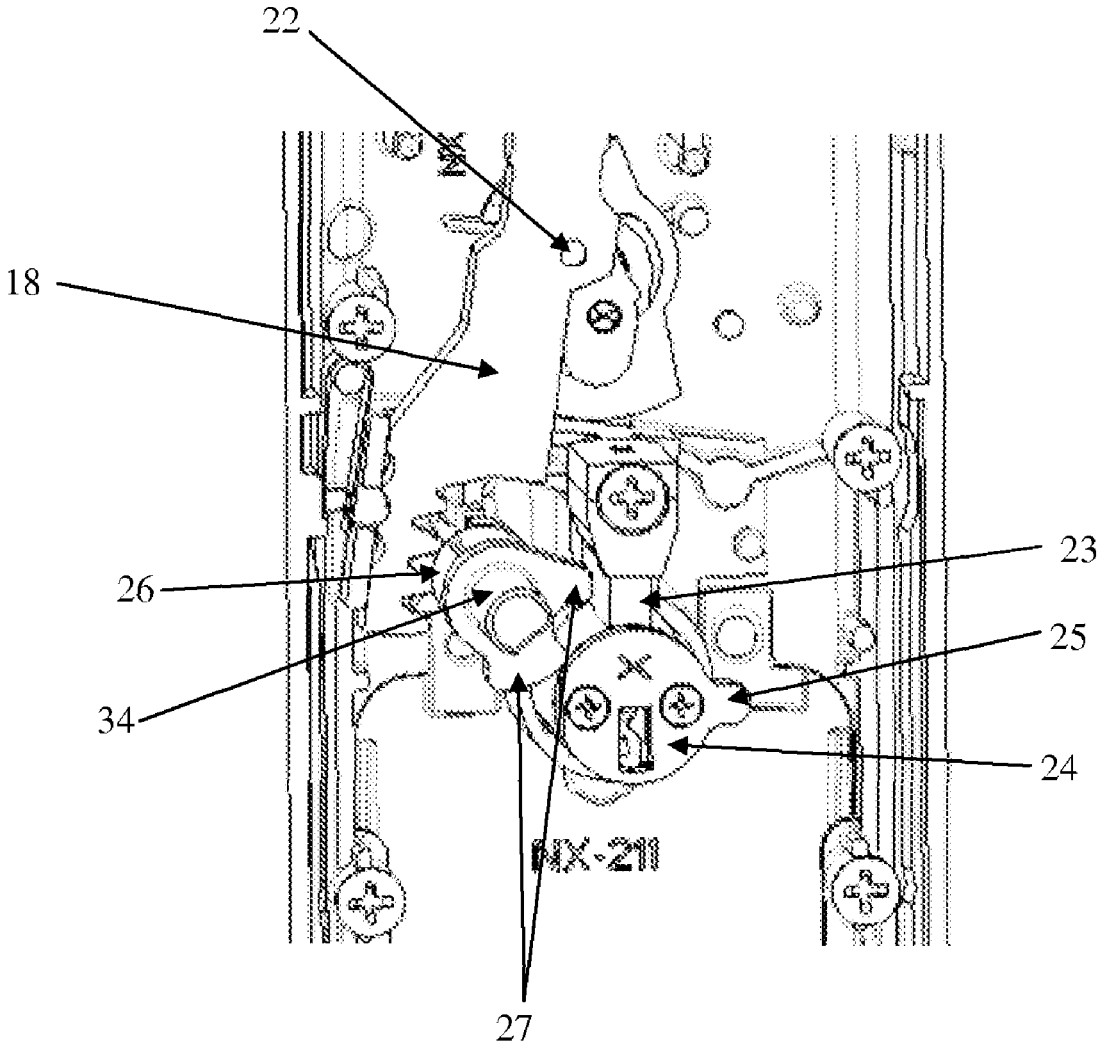
FIG. 4. Illustrates a close up view of the lower area of the lock bar and particularly illustrates the internal cam and the first drive member.
Figure 5:
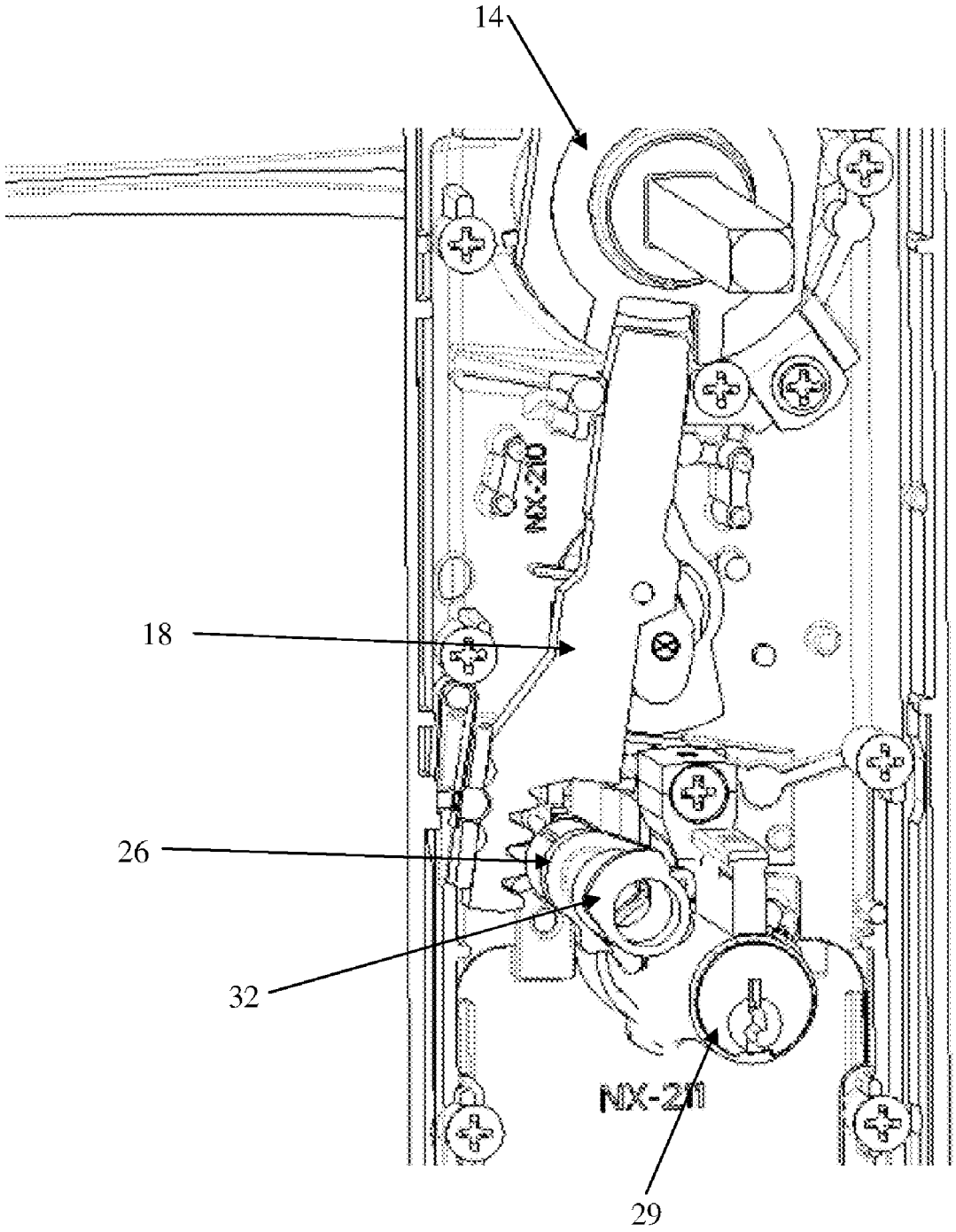
FIG. 5. Illustrates a close up view of the external cylinder.

The lock according to the particular embodiment is also able to adopt a deadlock position from the inside of the door. In the deadlock position, locking bar 18 is held in the locking position and is not able to be retracted to the free position by rotation of internal handle 12. FIG. 4 illustrates some detail of the mechanism which allows the lock to be deadlocked from the inside of the door. Specifically, an internal cylinder 23 is provided which is operated by a key. The internal cylinder extends through lock body 11 such that a key can be inserted into the internal cylinder 23 from the inside of the door. The inner end of internal cylinder 23 is attached to an internal cam 24 (this being quite conventional). The internal cam 24 is typically screwed to the inner end of internal cylinder 23 and contains a camming member 25. Insertion of a key into internal cylinder 23 and rotation of the key causes rotation of the camming member 25.

Adjacent internal cam 24 is a first drive member 26. First drive member 26 is best illustrated in FIG. 4. The first drive member 26 is mounted for rotation and contains a pair of lobes 27 which function to abut against camming member 25. Thus, rotation of camming member 25 in a clockwise or anticlockwise manner will ultimately cause the camming member 25 to strike one of the lobes 27 which will cause rotation of drive member 26. Drive member 26 engages with a lower part of locking bar 18 in the manner illustrated in FIG. 4. Thus, anticlockwise rotation of drive member 26 will cause retraction of locking bar 18 while clockwise rotation of drive member 26 will cause extension of locking bar 18. In this way, insertion and turning of a key in internal cylinder 23 can cause locking and unlocking of locking bar 18. However, when the locking bar has been moved to the locking position, removal of the key from internal cylinder 23 will cause the camming member 25 to remain in engagement with one of the lobes 27. The camming member 25 cannot rotate as the key has been removed from internal cylinder 23. Consequently, the first drive member 26 cannot rotate either which means that locking bar 18 cannot be retracted. Thus, the lock is now in the deadlock mode and the internal handle and the external handle cannot be rotated, the internal snib cannot be moved, and the door cannot be opened unless the key is reinserted into internal cylinder 23 and rotated to free camming member 25 from engagement against the first drive member 26.

Figure 6:
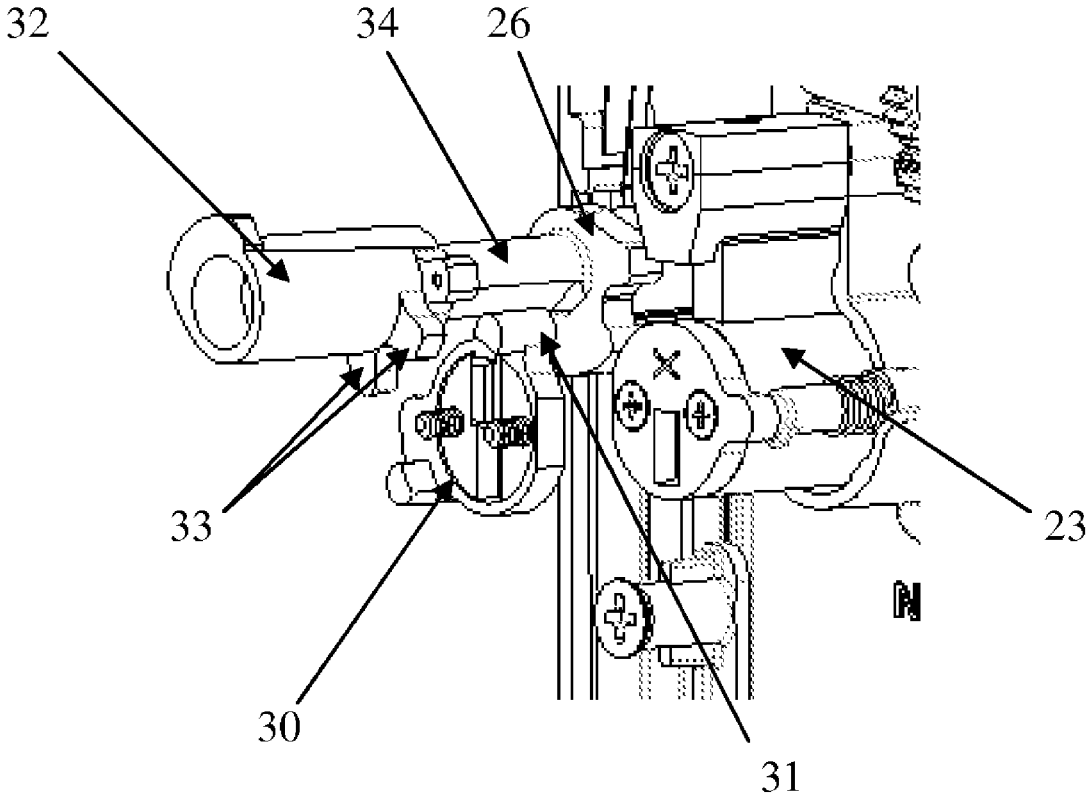
FIG. 6. Illustrates a close up view of FIG. 5 but from one side and particularly illustrates the external cam and the second drive member.

In the particular embodiment, the lock also has an external cylinder 29 which is illustrated in FIG. 1 and FIG. 2. The external cylinder also allows the lock to be deadlocked and also allows the lock to move from the deadlock mode to the privacy mode and the passage mode. This is achieved as follows: the external cylinder 29 also contains a cam 30 attached to the inner end of the external cylinder, and cam 30 is best illustrated in FIG. 6. In FIG. 6, only cam 30 has been illustrated and the external cylinder has been removed for reasons of clarity. Can 30 has a camming member 31 and adjacent cam 30 is a second drive member 32. Drive member 32 contains a pair of lobes 33 similar to that of first drive member 26, and camming member 31 strikes one of the lobes to cause rotation of second drive member 32. Thus, a key can be inserted into external cylinder 29 and turned to rotate cam 30 to cause second drive member 32 to rotate either in a clockwise direction or an anticlockwise direction. Second drive member 32 is attached to a shaft 34 which extends from first drive member 26 the shaft being best illustrated in FIG. 6. Rotation of second drive member will therefore cause corresponding rotation of the first drive member 26 and as the first drive member 26 engages with locking bar 18, rotation of second drive member 32 will also cause movement of locking bar 18 through the first drive member 26.

The lock can therefore be manipulated from the privacy mode and the deadlock mode by an external key passing into external cylinder 29. Again, when in the deadlock mode (that is when camming member 31 prevents rotation of second drive member 32 which in turn prevents rotation of first drive member 26 which in turn prevents retraction of locking bar 18), neither the internal handle, the external handle or the snib can be manipulated to unlock the door.

The lock can also be adapted for remote control, and an advantage of the invention is that the lock can be converted from a mechanical lock as described above to a remote control lock as will be described below without large changes to the lock components.

Figure 7:
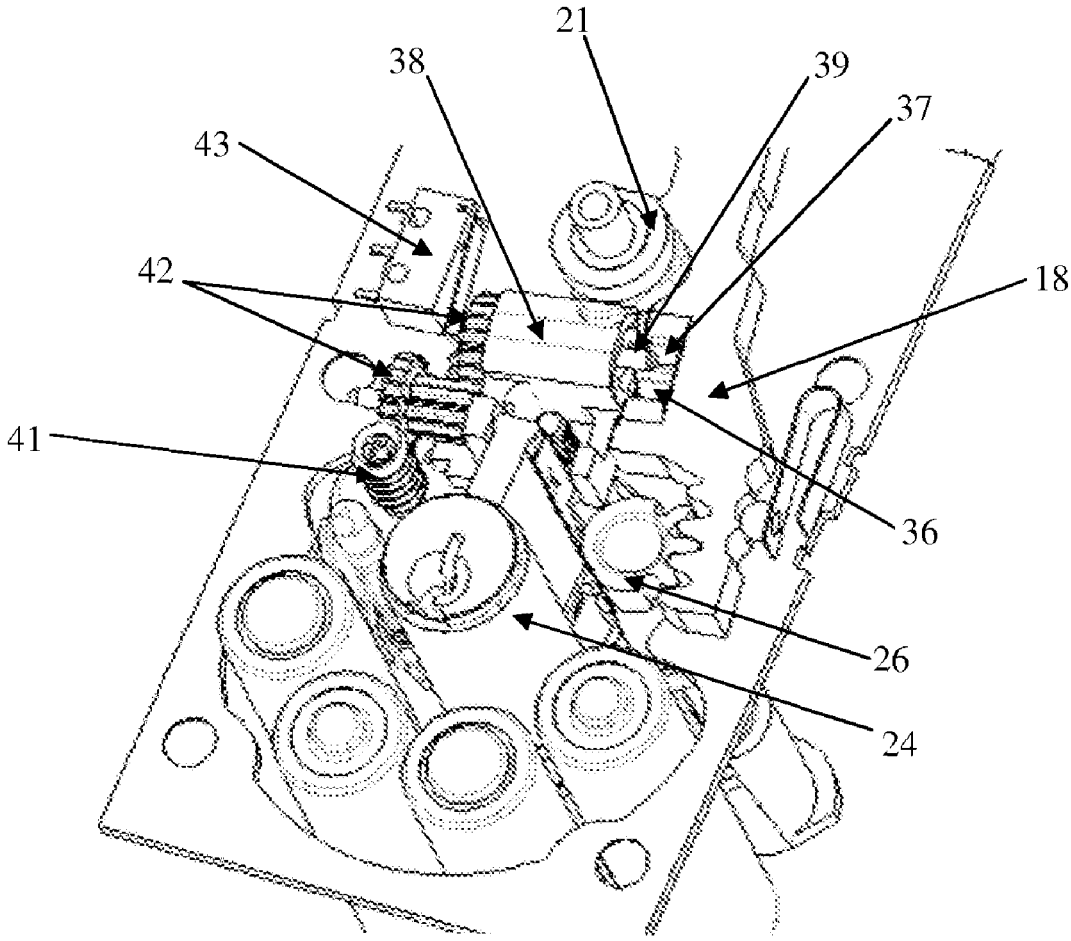
FIG. 7. Illustrates the remote control components of the lock and particularly illustrates the drive member which drives the locking bar.
Figure 8:
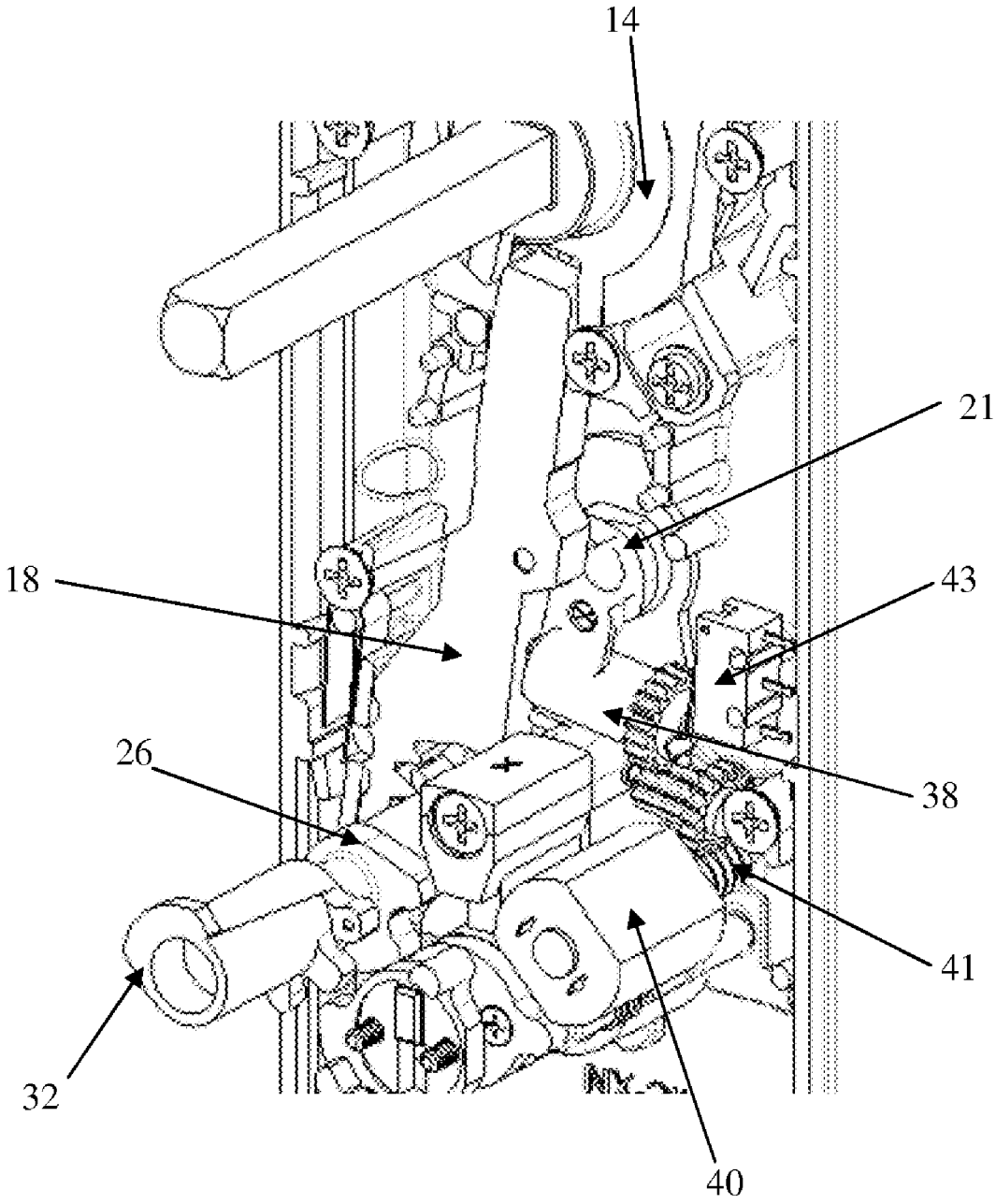
FIG. 8. Illustrates the remote control components of the lock and particularly illustrates the electric motor.

FIGS. 7 and 8 illustrates the remote control version of the lock. Referring initially to FIG. 7, there is illustrated the lower part of locking bar 18 which is manipulated by first drive member 26 the first drive member 26 being operated by the internal cylinder 23. Locking bar 18 contains a pair of spaced apart recesses 36, 37. Locking bar 18 can be moved from its locking position to its unlocking position by a drive member 38 which contains an extending pin 39 which can engage in either recess 36 or recess 37 depending on whether drive member 38 is rotated in a clockwise manner or an anticlockwise manner. Drive member 38 can also adopt a "free" position where pin 39 is spaced above recess 36 and recess 37 and does not engage either said recess. The drive member 38 can be rotated such that pin 39 engages in one said recess and continued rotation causes the pin to either pull locking bar 18 into the retracted position or extend locking bar 18 into the locking position.

Drive member 38 is operatively driven by a small electric motor 40 (see FIG. 8). Motor 40 contains a drive shaft in the form of a worm 41 (in FIG. 7 worm 41 is illustrated and the motor 40 has been removed for clarity). Worm 41 meshes with a number of gears 42, the arrangement being that activation of the small electric motor 40 can cause drive member 38 to either rotate in a clockwise manner or an anticlockwise manner as the case may be.

A microswitch 43 is provided to signal motor 40. An overload detection may be provided to prevent overloading the remote control components of the lock. The overload/microswitch -provides position sensing as to the locking bar.

Thus, the lock can be activated between the passage mode and the privacy mode by remote control if desired.

It should be appreciated that various other changes and modifications can be made to any embodiment described without departing from the spirit and scope of the invention.

The invention calimed is:

1. A door lock having a lock body, an outer handle for operating the lock from an outer side of the door, an inner handle for operating the lock from an inner side of the door, and a mechanism inside the lock body to allow the lock to have a passage mode wherein the lock is operable by either handle, a privacy mode wherein the lock is operable by the inner handle but not the outer handle, and a deadlock mode wherein the lock cannot be operated by the handles, the mechanism comprising an outer hub operatively associated with the outer handle, an internal hub operatively associated with the inner handle, both the internal and outer hubs mounted adjacent to either the inner handle or the outer handle, and a locking member movably engageable and disengageable with the outer hub and the internal hub, characterised in that when the lock is in the deadlock mode the locking member is maintained in engagement with both the internal and outer hubs to prevent operation of the lock by the handles, and further characterised in that when the lock is in the privacy mode, engagement of the locking member with both the internal and outer hubs prevents operation of the lock by the outer handle but upon operation of the inner handle the locking member is disengaged from the hubs thereby returning the lock to the passage mode wherein the locking member is disengaged from both the internal and outer hubs.

2. The lock of claim 1, wherein the outer hub and the internal hub are positioned next to each other with the internal hub being positioned behind the outer hub and between the outer hub and the lock body.

3. The lock of claim 1, wherein the outer hub and the internal hub are substantially planar in configuration and comprise members which are adapted for rotation in the lock body.

4. The lock of claim 1, wherein the inner handle and the outer handle are interconnected by a rotatable interconnecting member.

5. The lock of claim 4, wherein the outer hub is attached to the interconnecting member such that rotation of the interconnecting member causes rotation of the outer hub.

6. The lock of claim 5, wherein rotation of the inner handle causes rotation of the internal hub.

7. The lock of claim 1, comprising engagement means on the internal hub and the outer hub to allow the internal hub and the outer hub to engage with the locking member.

8. The lock of claim 7, wherein the engagement means comprises a recess in each hub.

9. The lock of claim 1, wherein the locking member is slideable and/or rotatable between engagement with the hubs and disengagement with the hubs.

10. The lock of claim 8, wherein the locking member is substantially plate like in configuration and contains a nose portion which is adapted for engagement with the internal hub and the outer hub.

11. The lock of claim 1, wherein the locking member is movable between engagement with the hubs and disengagement with the hubs by an external member.

12. The lock of claim 11, wherein the external member is a snib mechanism which comprises an external snib on the inner side of the door which can be manipulated to move the locking member between engagement with the hubs and disengagement with the hubs.

13. The lock of claim 12, wherein the snib mechanism comprises a rotatable member containing an eccentric pin which is attached to the locking member such that a crank type mechanism is provided whereby rotation of the external snib causes reciprocal movement of the locking member.

14. The lock of claim 10, wherein the recess in the internal hub has a ramped surface whereby rotation of the internal hub causes the ramped surface to engage with the nose portion of the locking member to push the locking member out of engagement with the hubs.

15. The lock of claim 1, comprising at least one lock cylinder.

16. The lock of claim 15 comprising two lock cylinders being an outer lock cylinder and an inner lock cylinder, the inner cylinder being key operated from the inner side of the door and the outer cylinder being key operated from the outer side of the door.

17. The lock of claim 16, wherein the inner cylinder is operatively associated with the locking member such that operation of the inner cylinder operates the locking member between engagement with the hubs and disengagement with the hubs.

18. The lock of claim 17, wherein with operation of the inner cylinder to move the locking member into engagement with the hubs, the locking member is maintained in engagement with the hubs, thus placing the lock in the deadlock mode.

19. The lock of claim 16, comprising a first drive member to drive the locking member between engagement with the hubs and disengagement with the hubs.

20. The lock of claim 19, wherein the inner cylinder has a cam, and the first drive member is rotatable and is operated by the cam of the inner cylinder such that insertion and rotation of a key in the inner cylinder causes rotation of the cam of the inner cylinder which in turn operates the drive member to move the locking member between engagement with the hubs and disengagement with the hubs.

21. The lock of claim 19 comprising a mechanism to operate the lock between the deadlock mode and the passage mode from the outer side of the door, the mechanism comprising the outer cylinder which has a cam, the cam of the outer cylinder being rotated upon insertion and rotation of a key in the outer cylinder, the cam of the outer cylinder being operatively associated with the locking member such that operation of the outer cylinder moves the locking member between engagement with the hubs and disengagement with the hubs and whereby when the locking member is moved into engagement with the hubs by operation of the outer cylinder, the locking member is maintained in engagement with the hubs, placing the lock in the deadlock mode.

22. The lock of claim 21, comprising a second drive member which is operatively associated with the cam of the outer cylinder such that rotation of that cam causes rotation of the second drive member.

23. The lock of claim 22, wherein the second drive member is operatively associated with the first drive member such that rotation of the second drive member causes rotation of the first drive member to cause the locking member to move from engagement with the hubs to disengagement with the hubs and vice versa.

24. The lock of claim 1 comprising a motor in the lock body to operate components in the lock body.

25. The lock of claim 24, wherein the motor is actuated by a remote control means.

26. The lock of claim 25, wherein the lock comprises a receiver to sense the remote control means.

27. The lock of claim 26, wherein the motor is operatively associated with the locking member such that operation of the motor moves the locking member between engagement with the hubs and disengagement with the hubs.

* * * * *